US012728365B2

(12) United States Patent
Wang

(10) Patent No.: US 12,728,365 B2
(45) Date of Patent: Sep. 8, 2026

(54) LEVITATION OBJECT CAPABLE OF ADJUSTING LEVITATING HEIGHT

(71) Applicant: Sung Ho Wang, Gyeonggi-do (KR)

(72) Inventor: Sung Ho Wang, Gyeonggi-do (KR)

( * ) Notice: Subject to any disclaimer, the term of this patent is extended or adjusted under 35 U.S.C. 154(b) by 388 days.

(21) Appl. No.: 17/618,948

(22) PCT Filed: Jun. 9, 2020

(86) PCT No.: PCT/KR2020/007462
§ 371 (c)(1),
(2) Date: Dec. 14, 2021

(87) PCT Pub. No.: WO2020/256330
PCT Pub. Date: Dec. 24, 2020

(65) Prior Publication Data

US 2022/0266160 A1 Aug. 25, 2022

(30) Foreign Application Priority Data

Jun. 20, 2019 (KR) ..... 10-2019-0073216

(51) Int. Cl.
*A63H 27/10* (2006.01)

(52) U.S. Cl.
CPC ..... *A63H 27/10* (2013.01); *A63H 2027/1008* (2013.01)

(58) Field of Classification Search
CPC ..... A63H 27/10; A63H 2027/1008–1091
See application file for complete search history.

(56) References Cited

U.S. PATENT DOCUMENTS 344,515 A * 6/1886 Biehl ..... A63H 27/10 446/225
755,976 A * 3/1904 White ..... D06M 15/643 273/124 R
916,605 A * 3/1909 Rouse ..... A63H 27/10 446/225
1,427,396 A * 8/1922 Keith ..... A63H 27/10 446/225

(Continued)

FOREIGN PATENT DOCUMENTS

CN 207809756 U 9/2018
JP S57-5297 A 1/1982

(Continued)

OTHER PUBLICATIONS

International Search Report from corresponding PCT Application No. PCT/KR2020/007462, issued on Sep. 17, 2020.

(Continued)

*Primary Examiner* — Michael D Dennis
*Assistant Examiner* — Matthew B Stanczak
(74) *Attorney, Agent, or Firm* — Harness, Dickey & Pierce, P.L.C.

(57) ABSTRACT

The present invention relates to a levitating object, and in particular a storage unit is formed such that the levitation height of the levitating object can be adjusted by adjusting the weight of a balance weight placed in the storage unit and the levitation force of the levitating object. To achieve the purpose, the levitating object according to the present invention comprises a gas container having a sealed structure such that it can be filled with a levitation gas, and a storage unit formed beneath the gas container.

6 Claims, 8 Drawing Sheets

(56) References Cited

U.S. PATENT DOCUMENTS 1,635,183 A * 7/1927 Jeannotte ..... A47B 83/00 182/129
1,916,527 A * 7/1933 Pastir ..... A63H 27/10 52/2.26
2,193,069 A * 3/1940 Krueger ..... A63H 27/10 446/226
2,701,935 A * 2/1955 Florence ..... A63H 27/10 244/33
2,856,732 A * 10/1958 Weismantel ..... A63H 37/00 446/14
3,635,528 A * 1/1972 Strom ..... A47C 7/22 297/445.1
3,672,083 A * 6/1972 Moran ..... A63H 3/06 40/540
D244,494 S * 5/1977 Dottinger ..... D6/350
4,038,777 A * 8/1977 Schwartz ..... A63H 27/10 244/30
4,145,838 A 3/1979 Mason
4,356,661 A 11/1982 Calderwood
4,458,963 A * 7/1984 Keddie ..... A47C 13/00 312/902
4,463,513 A * 8/1984 Wallace ..... A63H 27/10 446/222
D279,238 S * 6/1985 Ferdinand ..... D6/350
4,758,199 A * 7/1988 Tillotson ..... A63H 27/10 244/31
4,784,628 A * 11/1988 McArdle ..... A63H 27/10 446/225
4,810,223 A * 3/1989 Stockton ..... A63H 27/10 446/225
4,884,987 A * 12/1989 Mason ..... A63H 27/10 446/225
4,888,836 A * 12/1989 Calderwood ..... A47C 17/84 297/DIG. 3
4,903,958 A * 2/1990 DiCarlo ..... B42D 15/045 116/210
5,011,447 A * 4/1991 Watanabe ..... A63H 27/10 242/405
5,031,908 A * 7/1991 Spector ..... A63F 9/305 273/458
5,035,391 A * 7/1991 Steele ..... A63H 27/10 248/346.03
5,125,177 A * 6/1992 Colting ..... G09F 15/00 40/538
5,199,572 A * 4/1993 Abe ..... G09F 15/00 244/33
5,234,726 A * 8/1993 Dahan ..... B42D 15/045 229/923
5,254,026 A * 10/1993 Kaiser ..... A63H 27/10 40/775
5,411,427 A * 5/1995 Nelson ..... A63H 27/10 446/72
5,444,607 A * 8/1995 Dreyfuss ..... F21V 3/023 362/157
5,494,625 A * 2/1996 Hu ..... B29D 22/02 264/293
5,514,022 A * 5/1996 Harris ..... A63H 27/10 446/77
5,531,401 A * 7/1996 Newcomb ..... A63H 27/10 446/225
5,641,034 A * 6/1997 Calmeise ..... A47C 12/00 182/17
5,692,833 A * 12/1997 DeLuca ..... A63H 27/10 383/3
5,797,783 A * 8/1998 Harris ..... A63H 27/10 40/124.05
6,022,617 A * 2/2000 Calkins ..... B32B 5/022 156/298
6,165,039 A * 12/2000 Cobane ..... A63H 27/10 446/489
D446,949 S * 8/2001 Linder ..... D6/334
6,364,733 B1 * 4/2002 Escauriza ..... A63H 27/10 446/88
6,390,880 B1 * 5/2002 Almazan ..... A63H 27/10 446/81
6,568,012 B2 * 5/2003 Michaelis ..... A47C 27/10 5/413 AM
6,582,272 B1 * 6/2003 Nelson ..... A63H 27/10 446/220
6,716,083 B1 * 4/2004 Castro ..... A63H 27/10 242/405
7,008,020 B2 * 3/2006 Becker ..... A47C 7/62 297/452.41
D524,069 S * 7/2006 Lim ..... D6/350
7,207,627 B2 * 4/2007 Jerome ..... A47C 31/02 297/DIG. 6
D566,977 S * 4/2008 Emge ..... D6/350
D570,125 S * 6/2008 Gonzalez ..... D6/350
7,608,319 B2 * 10/2009 Montiel ..... B32B 5/18 442/101
7,963,820 B2 * 6/2011 Ansolabehere ..... H04R 1/028 446/397
9,724,616 B1 * 8/2017 Pedersen ..... A63H 27/10
10,328,354 B2 * 6/2019 Bushell ..... A63H 37/00
10,555,627 B1 * 2/2020 Domenichiello ..... A47G 1/14
11,382,432 B2 * 7/2022 Marsden ..... E06C 7/081
11,617,963 B2 * 4/2023 Hakuta ..... A63J 13/00 446/220
2003/0045202 A1 * 3/2003 Komar ..... G09F 21/06 446/221
2003/0104885 A1 * 6/2003 Jin ..... B29D 22/04 473/599
2003/0111760 A1 * 6/2003 Dyke ..... B32B 3/30 264/293
2007/0257594 A1 * 11/2007 Cayton ..... A63H 27/10 313/324
2008/0090487 A1 * 4/2008 Randall ..... A63H 33/22 446/225
2008/0093167 A1 * 4/2008 Saunders ..... A47C 12/00 182/222
2011/0254333 A1 * 10/2011 Taichman ..... A47C 7/46 5/652
2014/0004286 A1 * 1/2014 Sakellarides ..... A63H 27/10 428/36.6
2014/0015294 A1 * 1/2014 Sadler-Vandeplas ..... A47C 31/11 297/219.12
2015/0044936 A1 * 2/2015 Lofthouse ..... A63H 3/003 446/73
2017/0032719 A1 * 2/2017 Day ..... G09F 19/008
2017/0225089 A1 * 8/2017 Brant ..... A63H 3/005
2017/0246546 A1 * 8/2017 Brown, Sr. ..... A63H 3/02
2018/0243662 A1 * 8/2018 Bushell ..... B65D 5/5014
2018/0311919 A1 * 11/2018 Moscaritolo ..... B32B 27/32
2019/0161233 A1 * 5/2019 Day ..... B65D 81/368
2019/0336872 A1 * 11/2019 Brown, Sr. ..... B65D 81/365
2020/0032982 A1 * 1/2020 Bastian ..... F21S 9/02
2020/0046180 A1 * 2/2020 Nethercott ..... A47K 17/028
2020/0188804 A1 * 6/2020 Carroll ..... A63H 3/36
2021/0030142 A1 * 2/2021 Starkey ..... A63H 3/20
2022/0266160 A1 * 8/2022 Wang ..... A63H 27/10
2022/0323876 A1 * 10/2022 Jumani ..... A63H 27/10

FOREIGN PATENT DOCUMENTS

JP 05-007295 U 2/1993
JP H06-210986 A 8/1994
JP 08-280523 A 10/1996
JP H8-280523 A 10/1996
JP 2000-75826 A 3/2000
KR 20-1991-0009551 Y1 12/1991
KR 20-0336782 Y1 12/2003

(56) References Cited

FOREIGN PATENT DOCUMENTS

| | | | |
|---|---|---|---|
| KR | 10-2012-0115916 | A | 10/2012 |
| WO | WO-02/45809 | A1 | 6/2002 |

OTHER PUBLICATIONS

Supplementary European Search Report from corresponding European Patent Application No. 20827022.3, dated Jun. 9, 2023.
Extended European Search Report from corresponding European Patent Application No. 20827022.3, dated May 22, 2023.
Office Action from corresponding Japanese Patent Application No. 2021-573315, dated Feb. 7, 2023.

* cited by examiner

LEVITATION OBJECT CAPABLE OF ADJUSTING LEVITATING HEIGHT

CROSS-REFERENCE TO RELATED APPLICATIONS

This application is a national phase application of PCT Application No. PCT/KR2020/007462, filed on 9 Jun. 2020, which claims priority to Korean Patent Application No. 10-2019-0073216, filed on 20 Jun. 2019. The entire disclosure of the applications identified in this paragraph are incorporated herein by references.

TECHNICAL FIELD

The present invention relates to a levitating object, and in particular to a levitating object formed to have a storage unit to adjust the weight of a balance weight placed in the storage unit and a levitation force of the levitating object to adjust the levitation height thereof.

BACKGROUND ART

Exemplary levitating objects filled with levitation gases to levitate include hot air balloons, balloons, advertising balloons and the like, for which the size of gas containers and the type of levitation gases are set different in accordance with the purpose of each levitating object.

Among other levitating objects, balloons are filled with levitation gases and tied to a pulling cord not to allow the balloons to fly away into the sky.

Since a balloon filled with a levitation gas generally levitates, a pulling cord is tied to the balloon and fixed to enable the balloon not to fly away into the sky and to be positioned around its user.

Since such conventional balloons described above are just aloft in the air, children are soon tired of them, and often release the pulling cord to see the balloons fly high in the sky.

SUMMARY

Technical Problem

Therefore, the present disclosure addressing the aforementioned conventional problems provides a levitation height-adjustable levitating object configured to implement balance between the levitation force of a gas container shaped as pets, characters, airplanes, flying saucers and the like and the weight of a balance weight to enable the levitating object to levitate and be positioned at the height of user's eye level to result in continued inducement of entertainment, and keep a levitation position constant although the pulling cord is released.

Furthermore, the present disclosure provides a levitation height-adjustable levitating object configured to be formed with a storage unit to place something beneath the gas container.

Technical Solution

The levitating object in accordance with the present disclosure to achieve the aforementioned purpose includes a gas container of sealed structure to be filled with a levitation gas and a storage unit formed underneath the gas container.

Furthermore, in accordance with a preferred embodiment of the present disclosure, embossed patterns are formed on the upper surface of the gas container.

Moreover, in accordance with the preferred embodiment of the present disclosure, an anti-slip pad formed with the embossed patterns is attached to the upper surface of gas container.

Moreover, in accordance with the preferred embodiment of the present disclosure, the storage unit comprises a pocket of which the edge is attached to the gas container to allow one side to be open, and a switch unit of which the one side is attached to the gas container to open or close the open side of the pocket.

Furthermore, in accordance with the preferred embodiment of the present disclosure, the levitating object comprises a body of sealed structure, a partition wall melt and fixed to the inner side of the body and separating the gas container and the storage, and an opening formed in the body corresponding to the storage.

Moreover, in accordance with the preferred embodiment of the present disclosure, a balance weight is placed in the storage.

Moreover, in accordance with the preferred embodiment of the present disclosure, the balance weight is structured to be a thin plate, and at least one plate is placed in the storage.

Moreover, in accordance with the preferred embodiment of the present disclosure, the gas container is formed with a gas inlet for introducing the levitation gas.

Furthermore, in accordance with the preferred embodiment of the present disclosure, a pulling cord is fixed to the gas container.

Advantageous Effects

As described above, the levitation height of the levitation height-adjustable levitating object in accordance with the present disclosure can be adjusted by means of a balance weight so that the levitating object shaped as pets, characters, airplanes, flying saucers and the like can be positioned at the height of children's eye level. Therefore, pets, characters, airplanes, flying saucers and the like are positioned beside the children to enable them to have a feeling the levitating object follow them, and the children do not feel tired of seeing it, happily playing with the levitating object.

Meanwhile, since the levitation height-adjustable levitating object in accordance with the present disclosure is configured to be formed with a storage unit in the lower part to place something therein, it is easy to inspect and place the contents of storage unit readily.

DETAILED DESCRIPTION

The present disclosure will now be described in detail with reference to the accompanying drawings showing preferred embodiments of the levitating object with a storage unit in accordance with the present disclosure.

First Embodiment

Figure 1:
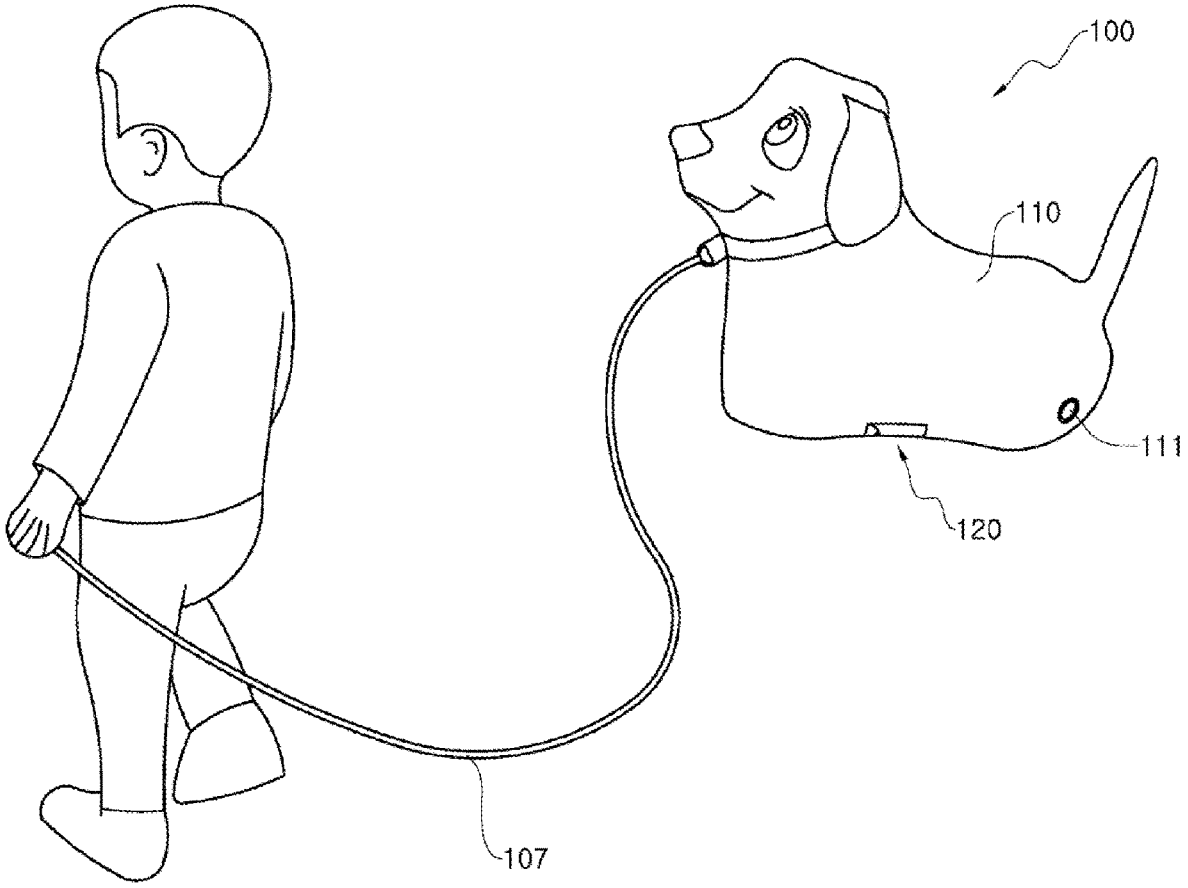
FIG. 1 shows a levitating object while used in accordance with a first embodiment of the present disclosure, and configured to be formed with a gas container shaped as a pet dog.
Figure 2:
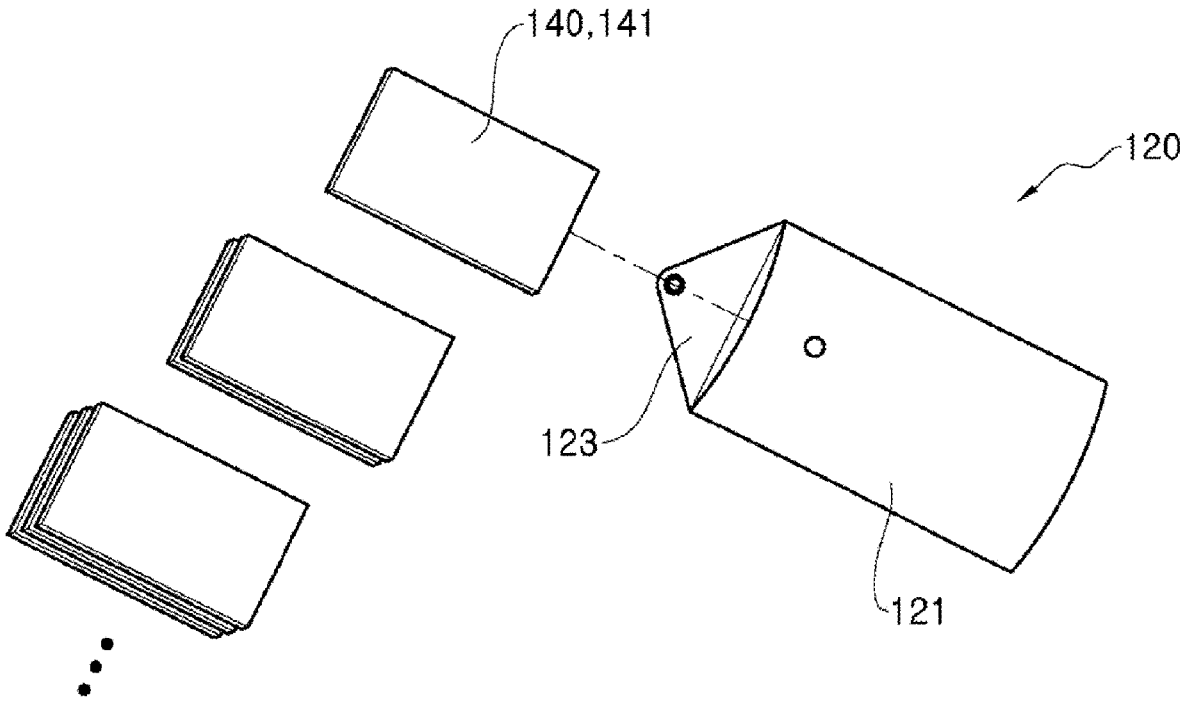
FIG. 2 is a conceptual view of a storage unit shown in FIG. 1.
Figure 3:
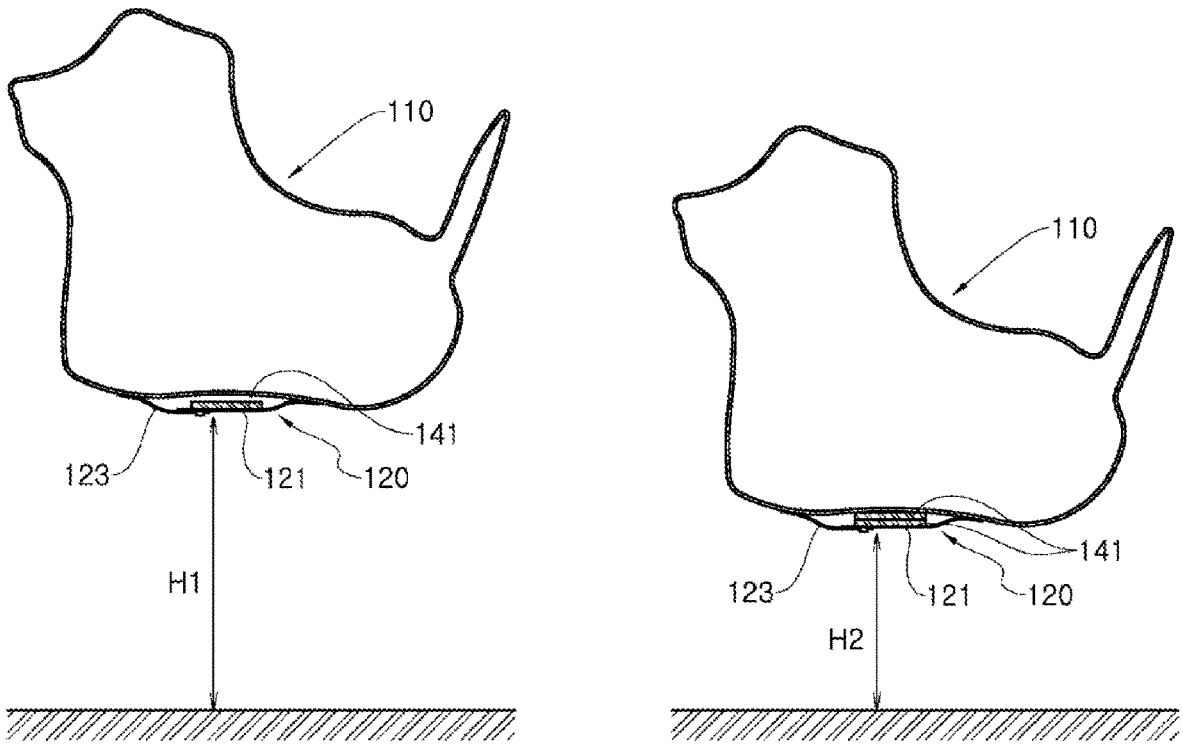
FIG. 3 is a conceptual view of height adjustment of the gas container depending on changes in the weight of a balance weight placed in the storage unit shown in FIG. 1.

In the drawings, FIG. 1 shows a levitating object while used in accordance with a first embodiment of the present disclosure, and configured to be formed with a gas container shaped as a pet dog. FIG. 2 is a conceptual view showing the storage unit shown in FIG. 1, and FIG. 3 is a conceptual view showing height adjustment of the gas container depending on changes in the weight of the balance weight placed in the storage unit shown in FIG. 1.

As shown in FIG. 1, the levitating object 100 is divided into a gas container 110 of sealed structure for storing a levitation gas and a storage unit 120 formed beneath the gas container 110.

The configuration of the gas container 110 and the storage unit 120 of the levitating object 100 will be described in more detail.

The gas container 110 is a space of sealed structure filled with the levitation gas therein, and is preferably configured with a synthetic resin to prevent the levitation gas from leaking. A gas inlet 111 for introducing the levitation gas is formed beneath the gas container 110.

More preferably, the gas container 110 can be shaped as pets, characters, airplanes, flying saucers and the like for inducing children's curiosity.

In the embodiment shown in FIG. 1, where the gas container 110 is shaped as a pet dog, the storage unit 120 is formed beneath the gas container 110.

The storage unit 120 includes a pocket 121 of which the edge is attached to the lower part of the gas container 110 to allow only one side to be open, and a switch unit 123 of which the one side is attached to the lower part of the gas container 110 to open or close the open side of the pocket 121.

As shown in FIG. 2, a thin weight plate 141 as a balance weight 140 is placed in the storage unit 120 through the opening of the pocket 121. As used herein, a snap button equipped on the other side of the switch unit 123 interlocks with a snap button equipped on the pocket 121 to close the open side of the pocket 121, preventing the weight plate 141 from being discharged outside the storage unit 120.

For this purpose, the user adjusts the number of weight plates 141 placed in the storage unit 120 in order to adjust the levitation height of the levitating object 100. In this embodiment, as shown in FIG. 3, as the number of weight plates 141 placed in the storage unit 120 increases, the weight thereof contributes to lowering the height H1, H2 of the levitating object 100, and the levitating object 100 which is the gas container 110 shaped as a pet dog stops at the point where the levitation by the levitation force gas keeps balance with the load of weight plates 141.

As a result, the user adjusts the number of weight plates 141 placed in the storage unit 120 to adjust the levitating object 100 with the gas container 110 to be positioned at the height of children's eye level.

The gas container 110 is configured to have a pulling cord 107 extended thereto so that children can pull the pulling cord 107 to move the levitating object 100.

With the levitating object 100 configured as described above, where the children hold the pulling cord 107 and walk to move, it gives them the feeling of their walking with a real pet dog as the gas container 110 shaped as a pet dog moves at the height of children's eye level, and other children close to them can easily see the gas container 110 to promote advertising effect by means of the gas container 110.

In FIG. 1, although only the levitating object 100 with the gas container 110 shaped as a pet dog is shown, the shape of gas container can be other pets, characters, airplanes, flying saucers and the like than the pet dog as described above.

Moreover, since the storage unit 120 of pocket structure is structured to be in close contact with the lower part of the gas container 110 to avoid discontinuity, and the balance weight 140 is structured to be a thin plate, it is an advantage that a plurality of the balance weight plates 141 are not readily noticeable externally although they are placed in the storage unit 120.

Second Embodiment

Although the storage unit is described to be a pocket in structure in the first embodiment, the second embodiment is different in terms of configuration in that the user can place something to be used therein instead of the balance weight plates. Therefore, while describing the configuration of the second embodiment, specific description of the same and similar configuration described in the first embodiment will not be further provided.

Figure 4:
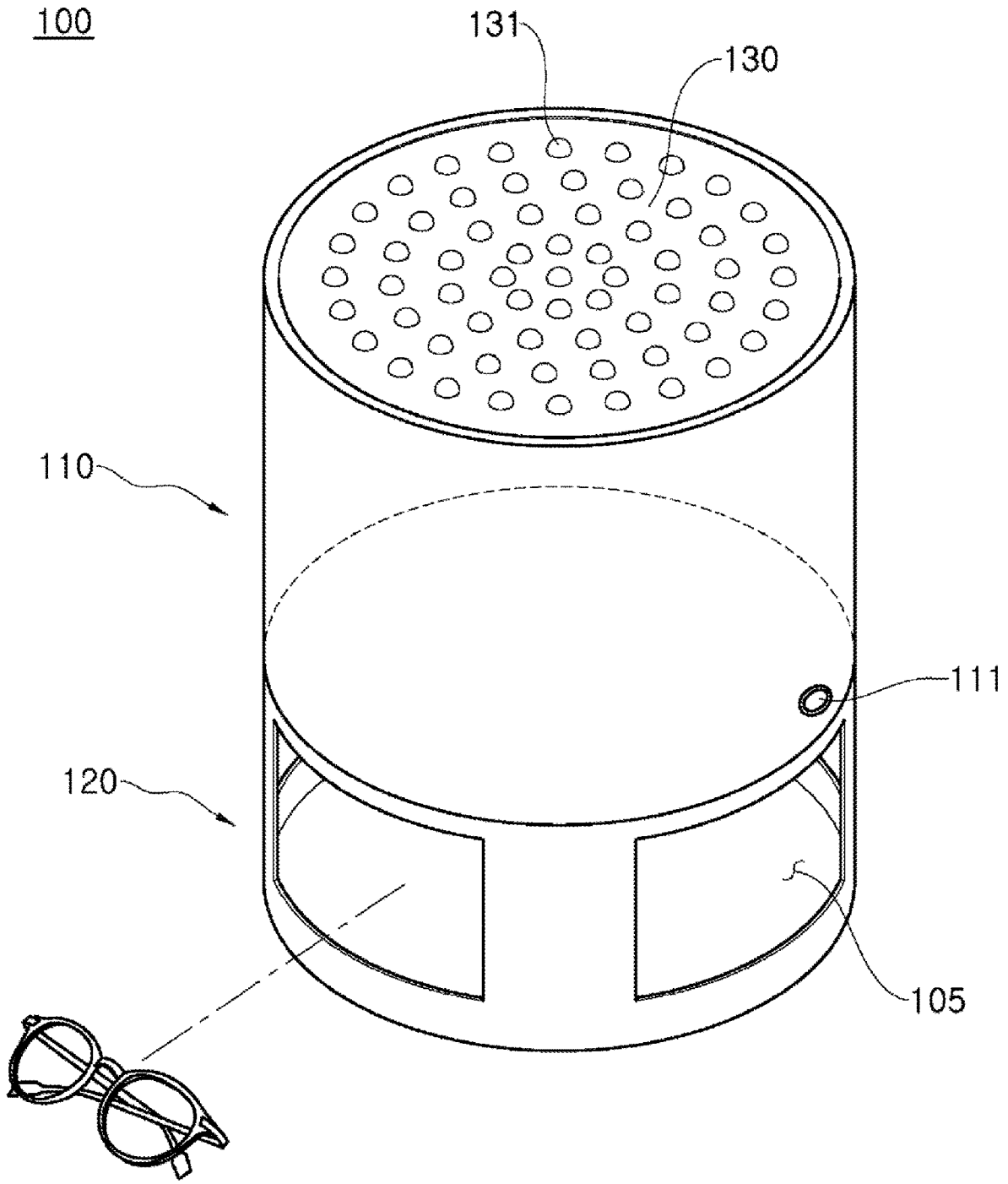
FIG. 4 is a perspective view of the levitating object in accordance with a second embodiment of the present disclosure.
Figure 5:
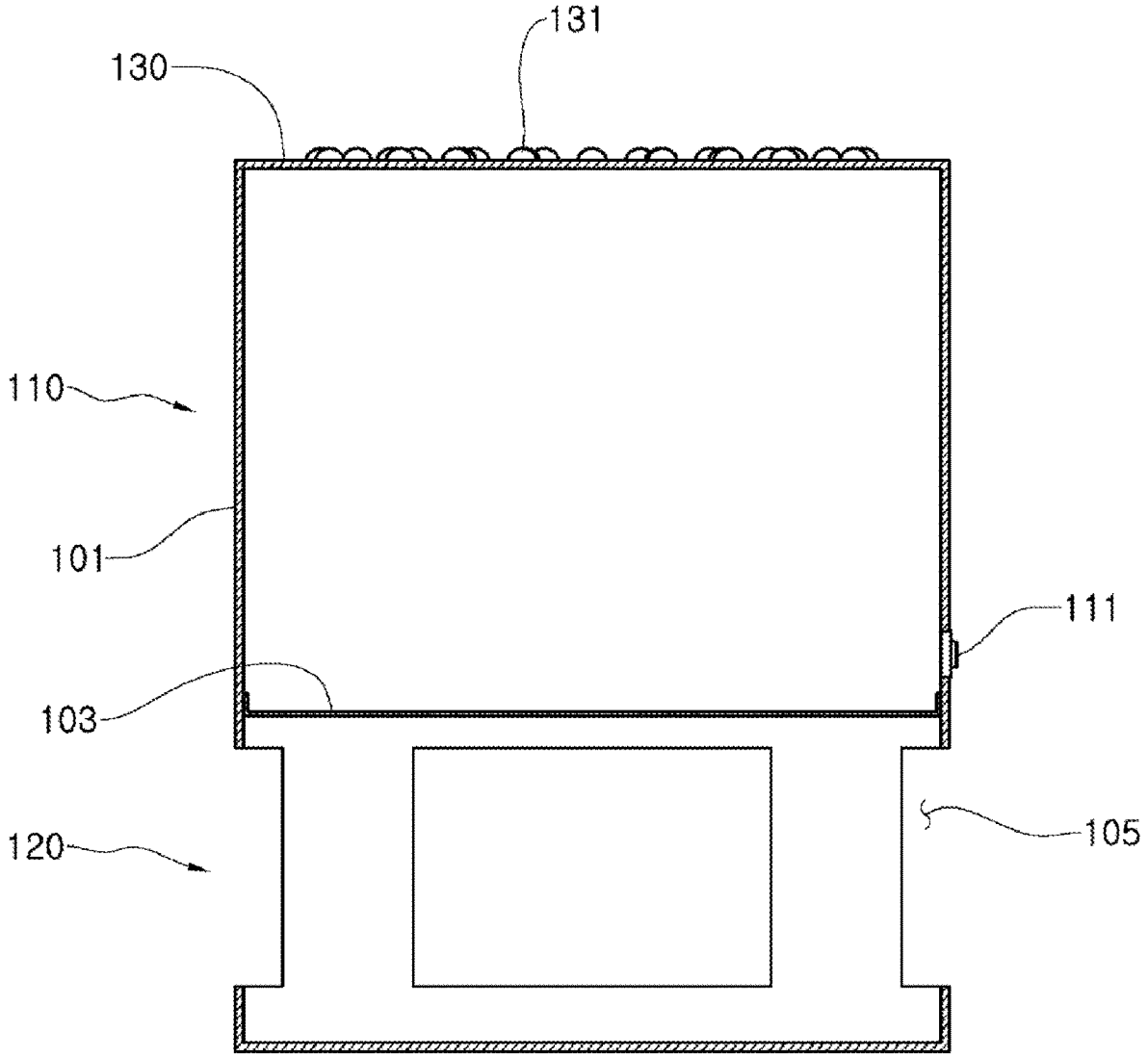
FIG. 5 is a cross sectional view of the levitating object shown in FIG. 4.
Figure 6:
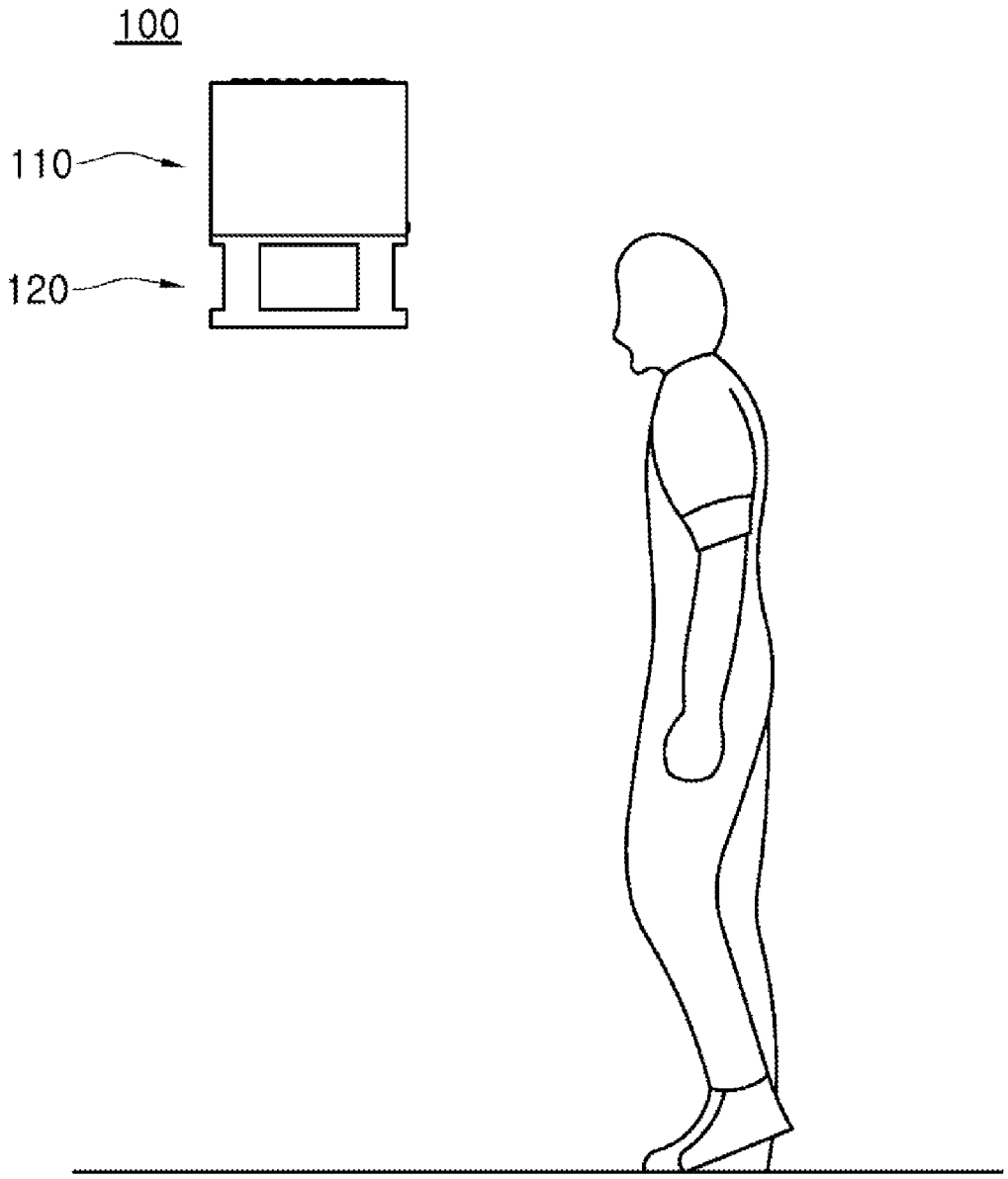
FIG. 6 is a conceptual view showing the state in which the height of the levitating object shown in FIG. 4 is positioned to be at user's eye level.
Figure 7:
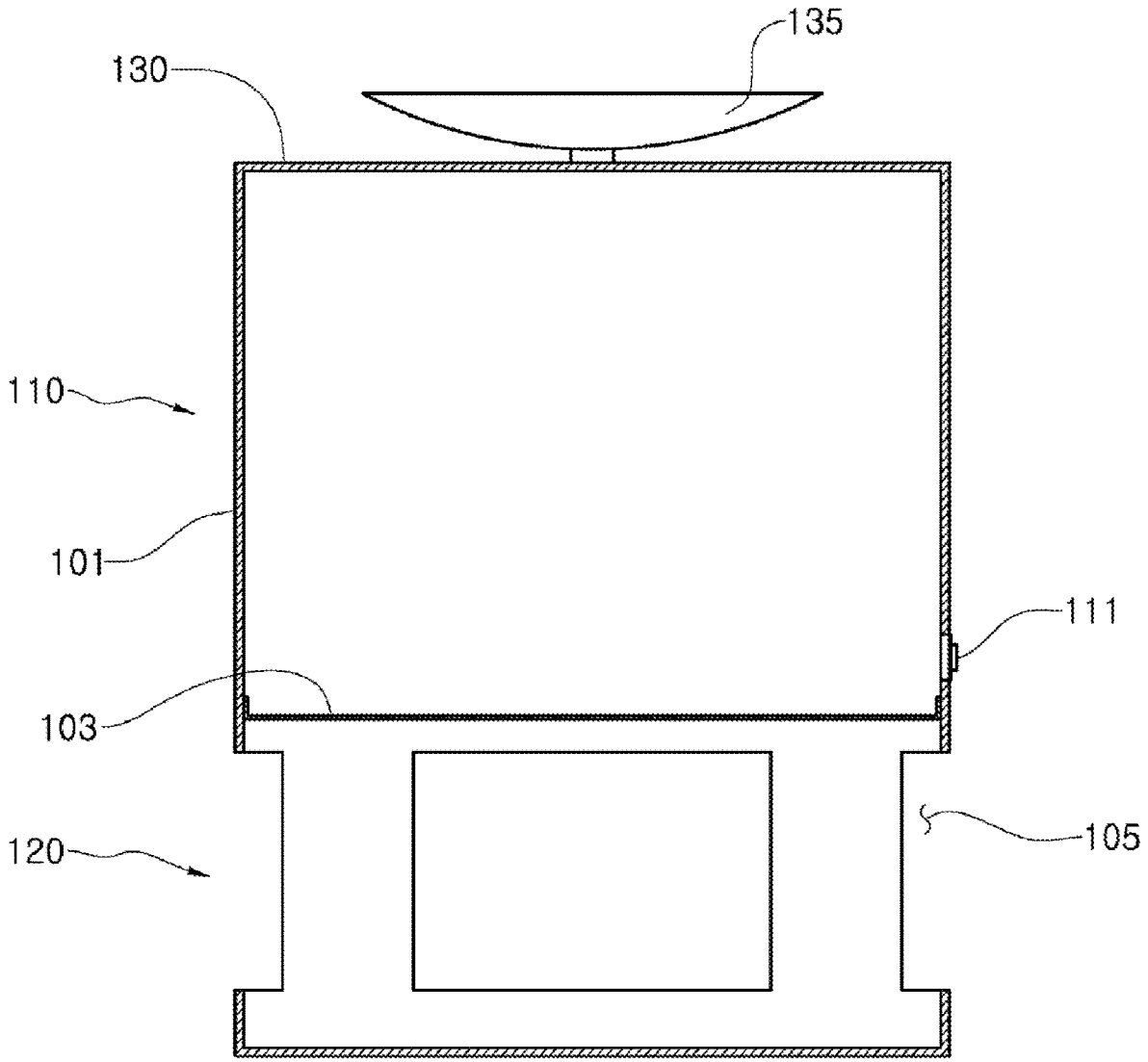
FIG. 7 is a perspective view of an exemplary variant of the levitating object shown in FIG. 4.
Figure 8:
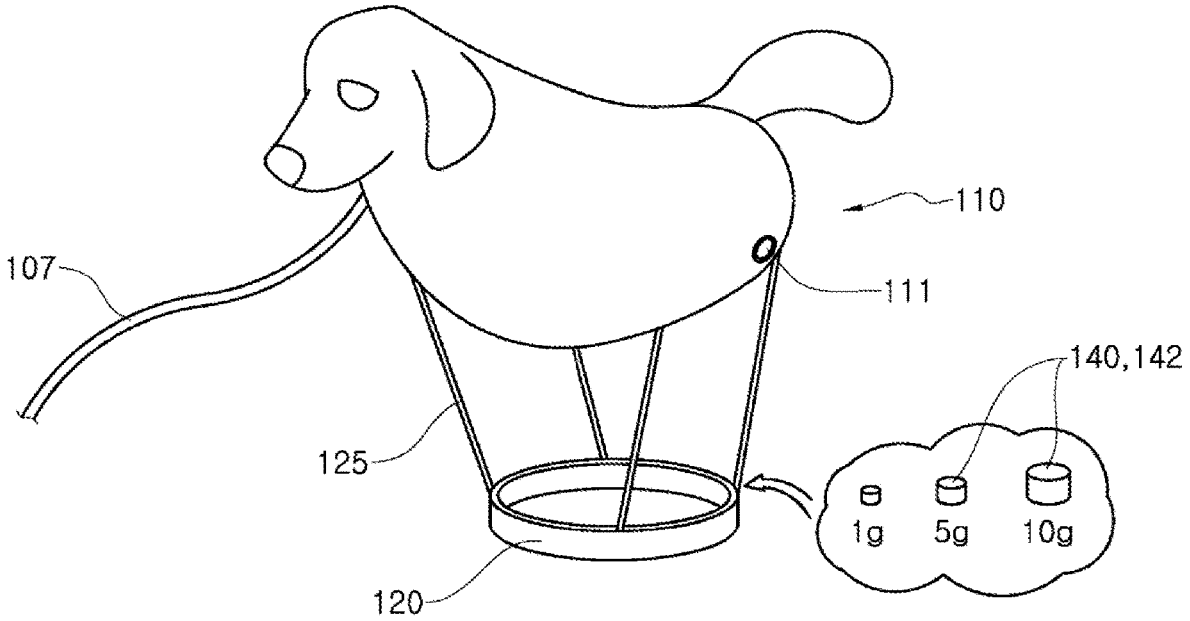
FIG. 8 is a perspective view of an exemplary variant of the levitating object shown in FIG. 1.

In the drawings, FIG. 4 is a perspective view of the levitating object in accordance with the second embodiment of the present disclosure; FIG. 5 is a cross sectional view of the levitating object shown in FIG. 4; and FIG. 6 is a conceptual view showing the state in which the height of the levitating object shown in FIG. 4 is positioned to be at user's eye level. FIG. 7 is a perspective view of an exemplary variant of the levitating object shown in FIG. 4; and FIG. 8 is a perspective view of an exemplary variant of the levitating object shown in FIG. 1.

As shown in FIGS. 4 to 6, while the levitating object 100 is preferably a cylinder in structure and an anti-slip pad 130 with embossed patterns is attached to the upper surface of the gas container 110, the gas container 110 can be configured, of which the upper surface is embossed in structure instead of the anti-slip pad 130.

The gas container 110 configured as described above is filled with incombustible helium gas as a levitation gas. Although not shown in the drawings, the helium gas in a high-pressure tank is introduced into the gas container 110 to fill it with the helium gas when the gas injection nozzle extended from the high pressure tank storing the helium gas is placed in the gas inlet 111.

When gas container 110 is filled with the helium gas, the levitating object 100 levitates depending on the amount of helium gas.

Meanwhile, the storage unit 120 is formed entirely underneath the gas container 110.

As shown in FIGS. 4 to 6, it is preferred that the gas container 110 and the storage unit 120 have a sealed cylindrical body 101, and a partition wall 103 is melt and fixed to the inner side of the body 101 not higher than the middle of the body 101 height to form the gas container 110 in the upper part and the storage unit 120 is formed in the lower part of the partition wall 103 which is in the middle. The storage unit 120 can be configured to have at least one opening 105 formed around its circumference to allow something as a balance weight, glasses in FIG. 4, to be placed therein. In other words, the storage unit is defined by a bottom wall opposing the partition wall and at least one sidewall extending between the bottom wall and the partition wall, where the at least one sidewall of the storage unit defines at least one opening in communication with an interior space of the storage unit.

While the amount of levitation gas filling the gas container 110 determines the weight of the contents placed in the storage unit 120, the weight of contents to be placed also increases as more levitation gas is introduced for a bigger gas container 110.

The relation between using the levitating object with the storage unit configured as described above and placing something to be used therein will be further described below.

As shown in FIGS. 4 to 6, when the gas container 110 is filled with a proper amount of the levitation gas to generate a levitation force, the levitating object 100 thus levitates. While the levitating object 100 levitating indoors touches the ceiling or contacts desks or the lower part of other fixtures arranged there, the embossed patterns 131 of the anti-slip pad 130 touch the ceiling or the lower part of other fixtures to generate frictional forces. The generated frictional forces support the levitating object 100 to prevent it from moving with the indoor air flow. That is to say, where the embossed patterns 131 of the anti-slip pad 130 or raised patterns formed on top of the gas container not shown in the drawings are not provided, the levitating object 100 moves here and there indoors with the indoor air flow, but the frictional forces can prevent the levitating object 100 from moving where the embossed patterns 131 touch a flat ceiling or the lower surface of fixtures, for example, a table.

Where something to be used is placed in the storage unit 120 of the levitating object 100 levitating as described above, the weight of the contents contributes to making the levitating object 100 move downward. Where the weight of contents placed in the storage is greater than the levitation force generated according to the amount of levitation gas in this case, the levitating object 100 goes downward, but levitates towards the ceiling where the weight of contents placed in the storage is smaller than the levitation force, and an optimum balance between the levitation force and the weight of contents placed in the storage makes the levitating object 100 levitate to an optimum height in the room as shown in FIG. 6.

Where the levitating object 100 levitates to the height of user's eye level, the contents placed in the storage unit 120 are readily shown and found, and it is easy to know there is nothing placed in the storage unit because it is positioned to touch the ceiling.

Meanwhile, as shown in FIG. 7, a suction cup 135 can be attached instead of the anti-slip pad 130. For this purpose, the suction cup 135 can be attached and fixed to the lower surface of a fixture to fix the levitating object 100 to the fixture in order to use the storage unit 120 as an ordinary storage.

Meanwhile, while a levitating object with the storage unit in accordance with the present disclosure is shaped as a doll, and the storage unit 120 is formed beneath the gas container 110, the storage unit 120 is configured to place a plurality of balance weights 142, for example, 0.1 g, 1 g, 10 g, 100 g, etc., therein as a weight for adjusting the levitation height of the levitating object 100 to allow easy adjustment of the levitation height of levitating object 100.

Meanwhile, as shown in FIG. 8, the storage unit 120 for placing the balance weight 142 can be installed into the gas container 110 shaped as a pet dog shown in FIG. 1. The storage unit 120 of pocket structure shown in FIG. 1 can be replaced by the storage unit 120 for placing the balance weight 142 described above.

For this purpose, as shown in FIG. 8, a dish-shaped storage unit 120 for placing the balance weight can be configured to be connected to a plurality of cords 125 of which one end is connected to the gas container 110 to place the balance weight 142 in the storage unit 120.

What is claimed is:

1. A levitating object, comprising:

a body, including a gas container, having at least one exterior wall defining a sealed structure to be filled with a levitation gas and a storage unit formed entirely underneath the gas container; and a partition wall fixed to an inner side of the at least one exterior wall of the body, and extending across the body to separate the gas container and the storage unit, wherein the storage unit is defined by a bottom wall opposing the partition wall and at least one sidewall extending between the bottom wall and the partition wall, wherein the at least one sidewall of the storage unit defines at least one opening in communication with an interior space of the storage unit; and wherein the gas container includes an upper surface having an embossed pattern configured to generate a frictional force when contacted, or wherein the levitating object includes an anti-slip pad attached to an upper surface of the gas container and having an embossed pattern configured to generate a frictional force when contacted.

2. The levitating object of claim 1, wherein the storage unit comprises a pocket including a side defining an opening and an edge attached to the gas container, and a cover attached to the side of the pocket and configured to cover or uncover the opening of the pocket.

3. The levitating object of claim 1, further comprising a balance weight positioned in the storage unit.

4. The levitating object of claim 3, wherein the balance weight includes at least one thin plate.

5. The levitating object of claim 1, wherein the gas container is formed with a gas inlet for introducing the levitation gas.

6. The levitating object of claim 1, further comprising a pulling cord fixed to the gas container.

* * * * *